US005632635A

United States Patent [19]

Vanbesien et al.

[11] Patent Number: 5,632,635

[45] Date of Patent: May 27, 1997

[54] ELECTRIC CONNECTOR ARRAY

[75] Inventors: Johan Vanbesien, Izegem; Jacques Longueville, Oostkamp, both of Belgium

[73] Assignee: Siemens Aktiengesellschaft, Munich, Germany

[21] Appl. No.: 577,563

[22] Filed: Dec. 22, 1995

[30] Foreign Application Priority Data

Dec. 22, 1994 [DE] Germany ..... 44 46 100.3

[51] Int. Cl.[6] ..... H01R 4/66

[52] U.S. Cl. ..... 439/108; 439/608

[58] Field of Search ..... 439/101, 108, 439/608, 947

[56] References Cited

U.S. PATENT DOCUMENTS

| | | | |
|---|---|---|---|
| 4,571,014 | 2/1986 | Robin et al. | 439/608 |
| 5,104,341 | 4/1992 | Gilissen et al. . | |
| 5,342,211 | 8/1994 | Broeksteeg | 439/608 |

FOREIGN PATENT DOCUMENTS

| | | |
|---|---|---|
| 0486298 | 5/1992 | European Pat. Off. . |
| 4040551 | 4/1992 | Germany . |

OTHER PUBLICATIONS

"Frisierter Sipac–Stecker", Markt und Technik . . . No. 26, Jun. 24, 1994, pp. 36–37.

*Primary Examiner*—Neil Abrams
*Assistant Examiner*—Yong Kim
*Attorney, Agent, or Firm*—Herbert L. Lerner; Laurence A. Greenberg

[57] ABSTRACT

An electric connector array includes a knife strip and a spring strip of insulating material each having a plurality of signal contacts being disposed in columns and rows for connection to one another by being plugged together, and each of the signal contacts being shielded on all sides by sheet-metal elements. Ground strips which are disposed in the knife strip extend over an entire length of the knife strip and are disposed between adjacent signal contact rows. Small ground plates are disposed in the spring strip between adjacent signal contact columns. Each of the ground strips have pin-like ground contacts disposed in an intermediate grid relative to the signal contacts, for making a pluggable electrical contact with each of the small ground plates.

4 Claims, 3 Drawing Sheets

ELECTRIC CONNECTOR ARRAY

BACKGROUND OF THE INVENTION

Field of the Invention

The invention relates to an electric connector array, including a knife strip and a spring strip of insulating material, each having a plurality of signal contacts being disposed in columns and rows and being connectable to one another by being plugged together, and each individual signal contact being shielded on all sides by sheet-metal elements.

Low-frequency printed wiring board plug connectors are increasingly being operated with faster digital signals. Very steep leading edges of the signals correspond with high frequencies. That creates problems in terms of the quality of signal transmission and in particular, undesirable crosstalk effects occur between adjacent signal contacts.

Conventionally, the problem of crosstalk can be solved by passing the signals through only every other contact, while the intervening contacts are occupied by ground. In that solution, however, the number of terminals that are usable for signal transmission is drastically reduced, and therefore that solution hardly appears useful for applications involving a high signal density.

It is known from German Patent DE 40 40 551 C2, corresponding to U.S. Pat. No. 5,104,341, to prevent crosstalk between adjacent terminals in adjacent vertical rows by inserting a shielding element between the vertical terminal rows of a spring strip. A disadvantage in that case, however, is that of the five available rows of contacts, only three rows are usable for signals, while two rows are occupied by ground. Published European Patent Application 0 486 298 A1 on the other hand discloses a connector array in which ground contacts are each disposed between the signal contacts while being offset by one-half the period, so that in the assembled state the signal contacts are surrounded by ground contacts. That device again is not ideal, because the individual contacts for carrying the ground are all contacted individually, thus making routing of the signals considerably more difficult.

A member of the 2.5 mm "SIPAC" plug connector family in accordance with the structure mentioned initially above has become known from a publication entitled: Markt und Technik—Wochenzeitung für Elektronik [Market and Industry—Weekly Newspaper of Electronics], No. 26, Jun. 24, 1994, pp. 36–37. In that device, however, continuous shielding of each individual contact is carried out with a tight, square metal shaft. A "compartment structure" of lengthwise and crosswise metal sheets or plates that are required for this shaft and are spaced apart from one another by 2.5 mm, is located entirely inside the spring strip. Slits must therefore be provided at the points of penetration of the crosswise and lengthwise sheets or plates. The slits intermesh with one another and make a high-quality electrical contact with one another.

SUMMARY OF THE INVENTION

It is accordingly an object of the invention to provide an electric connector array, which overcomes the hereinaforementioned disadvantages of the heretofore-known devices of this general type, which can be used in particular as a printed wiring board plug connector, which prevents undesired crosstalk effects and which is simple to produce.

With the foregoing and other objects in view there is provided, in accordance with the invention, in an electric connector array including a knife strip and a spring strip of insulating material each having a plurality of signal contacts being disposed in columns and rows for connection to one another by being plugged together, and each of the signal contacts being shielded on all sides by sheet-metal elements, the improvement comprising ground strips being disposed in the knife strip, extending over an entire length of the knife strip and being disposed between adjacent signal contact rows; small ground plates being disposed in the spring strip between adjacent signal contact columns; and each of the ground strips having pin-like ground contacts disposed in an intermediate grid relative to the signal contacts, for making a pluggable electrical contact with each of the small ground plates.

In accordance with another feature of the invention, the knife strip and the spring strip along with the ground strips and the small ground plates are connected by a press-in technique to two printed wiring boards to be connected by the connector array, for optimizing a geometrical disposition of ground terminals relative to signal terminals in view of a routing of the signals.

In accordance with a further feature of the invention, there are provided additional external shielding plates being electrically independent of an intermeshing of the ground contacts.

In accordance with a concomitant feature of the invention, there are provided additional external shielding plates being electrically connected with an intermeshing of the ground contacts.

Other features which are considered as characteristic for the invention are set forth in the appended claims.

Although the invention is illustrated and described herein as embodied in an electric connector array, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
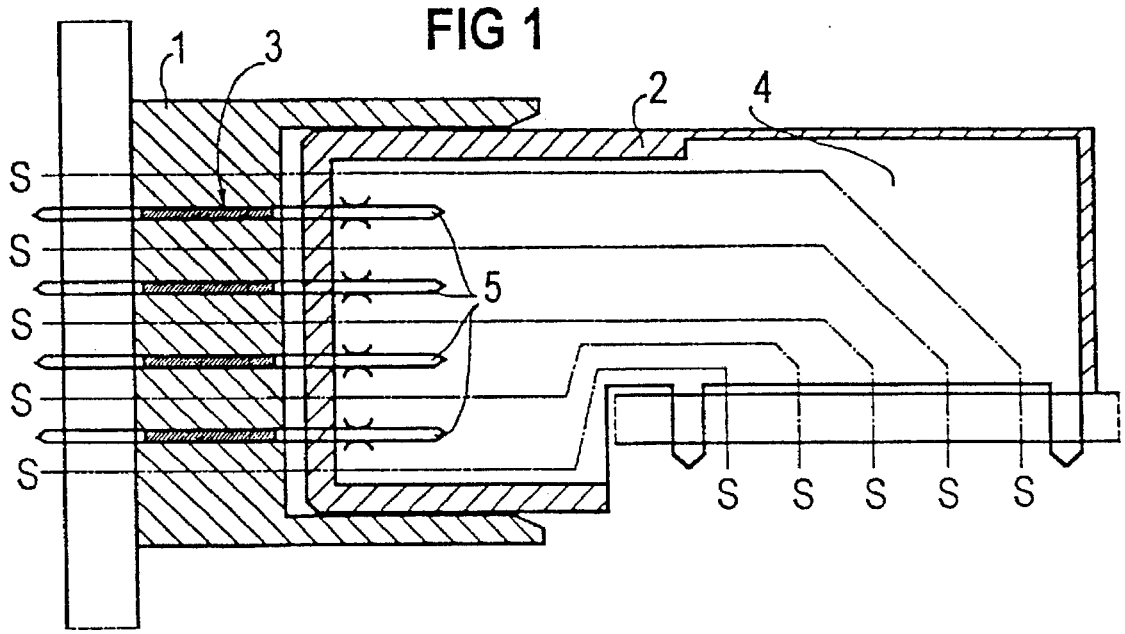
FIG. 1 is a longitudinal-sectional view of a connector array according to the invention.

Referring now to all of the figures of the drawing as a whole, it is seen that the present invention fights crosstalk with ground strips and small ground plates, which are located separately for knife and spring strips between rows and columns of contacts, respectively. The result is an intermeshing of all of the ground contacts, with a homogeneous shielding action regardless of the location of the contact in the printed wiring board plug connector. The precise disposition of ground strips 3 or small ground plates 4 in the plug connector can best be seen from FIGS. 1 and 2, while the intermeshing is most clearly apparent in FIGS. 3–7.

Figure 2:
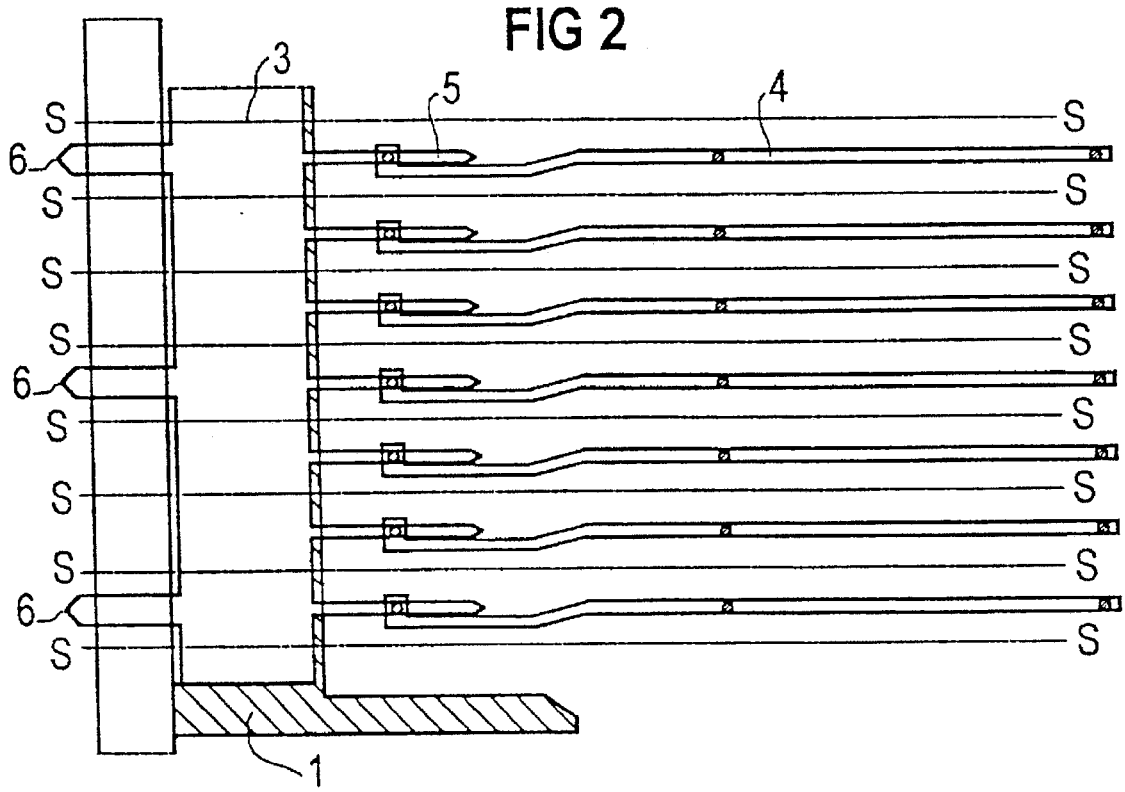
FIG. 2 is a plan view of the connector array of FIG. 1.
Figure 3:
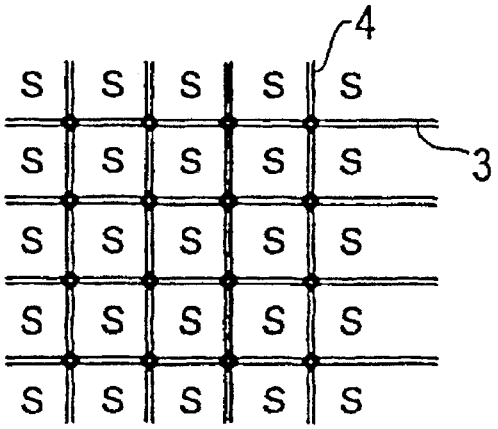
FIGS. 3–7 are views showing various versions of the shielding on all sides of the signal contacts through the use of an intermeshing of all of the ground contacts and through the use of additional external shielding walls, as applicable.

In FIG. 1 and especially in FIG. 2 it is shown how a pluggable electrical contact of the small ground plates 4 with pin contacts 5 of the ground strips 3 is made. This contact, once made, persists over the entire plug region and assures the service life of the plug. The small ground plates 4 are preferably connected to the printed wiring board by press-in technology. The connection is made to an edge of the printed wiring board in some cases and behind signal terminals in the other cases, so as to present as little difficulty as possible in routing of the signals. The ground strips 3 extend over the entire length of the plug connector and they are connected at regular intervals to the printed wiring board by a press-in technique, as is suggested in FIG. 2. A spacing between connection points 6 is chosen in such a way that the routing is impeded as little as possible and the shielding action remains optimal. A position of the signal contacts is indicated by a letter "S" in FIGS. 1 and 2.

Figure 4:
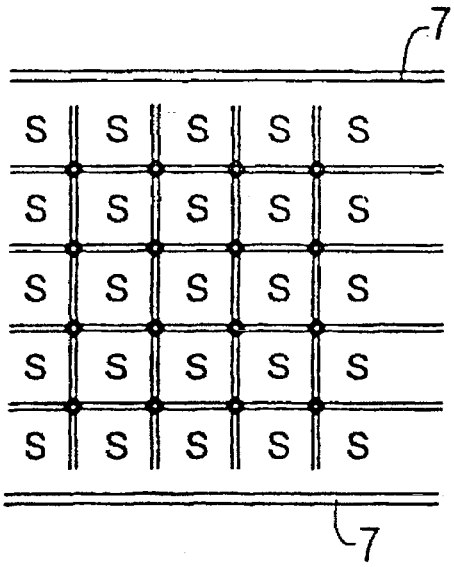
Figure 5:
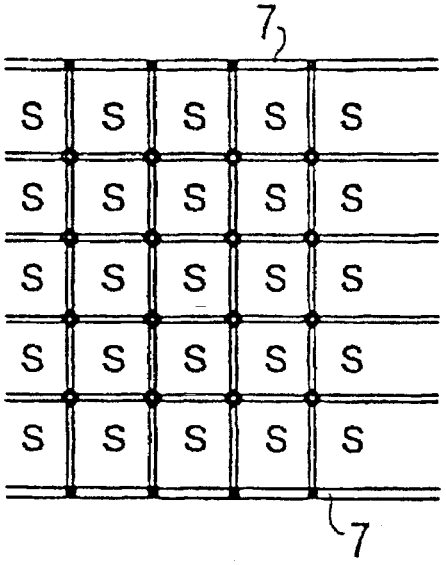
Figure 6:
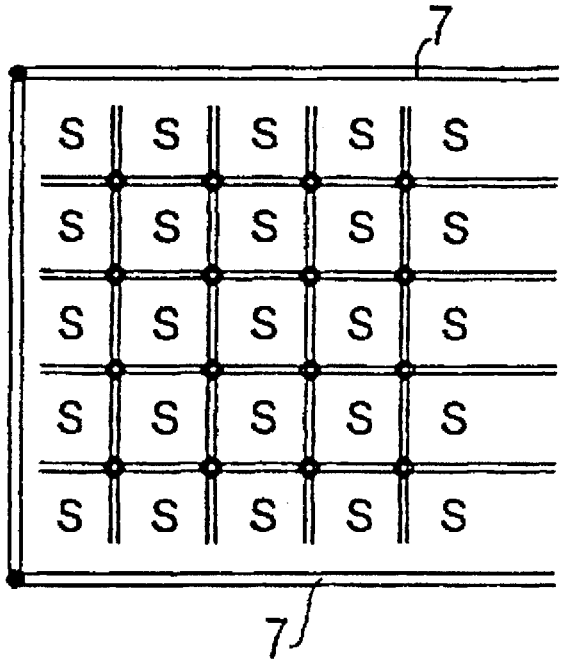
Figure 7:
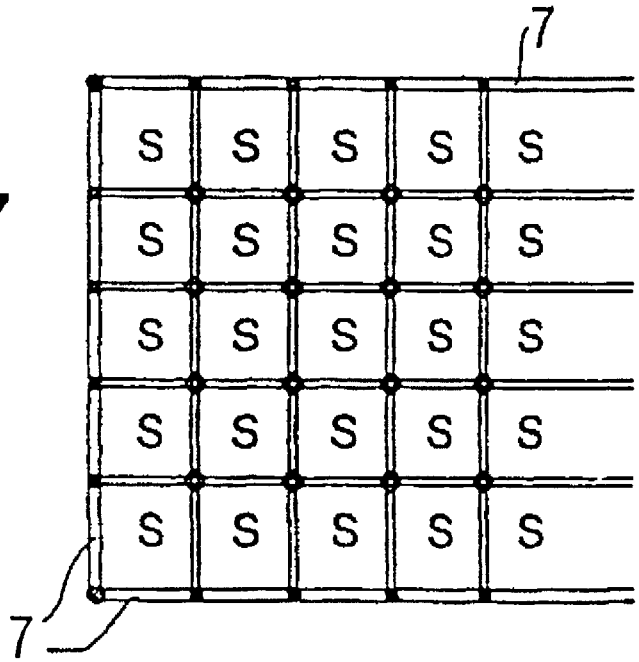

The pressing-in of the small ground plates 4 and the ground strips 3 can advantageously be carried out through an insulating body, so that pressing-in tools can be held as simply as possible. In a combination with external shielding plates 7, the small ground plates 4 and the strips 3, as shown in FIGS. 4–7, can be operated independently of the shielding plates or may also be connected to them. This is true both for two lateral shielding plates, as seen in FIGS. 4 and 5, and for a shielding cage encompassing 360°, as shown in FIGS. 6 and 7.

We claim:

1. In an electric connector array including a knife strip and a spring strip of insulating material each having a plurality of signal contacts being disposed in columns and rows for connection to one another by being plugged together, and each of the signal contacts being shielded on all sides by sheet-metal elements, the improvement comprising:

a) ground strips being disposed in the knife strip, extending over an entire length of the knife strip and being disposed between adjacent signal contact rows;

b) small ground plates being disposed in the spring strip between adjacent signal contact columns; and c) each of said ground strips having pin-like ground contacts disposed in an intermediate grid relative to the signal contacts, for making a pluggable electrical contact with each of the small ground plates.

2. The connector array according to claim 1, wherein said knife strip and said spring strip along with said ground strips and said small ground plates are connected by a press-in technique to two printed wiring boards to be connected by the connector array, for optimizing a geometrical disposition of ground terminals relative to signal terminals in view of a routing of the signals.

3. The connector array according to claim 1, including additional external shielding plates being electrically independent of an intermeshing of said ground contacts.

4. The connector array according to claim 1, including additional external shielding plates being electrically connected with an intermeshing of said ground contacts.

* * * * *